US007611258B1

(12) United States Patent
Chase

(10) Patent No.: US 7,611,258 B1
(45) Date of Patent: Nov. 3, 2009

(54) OUTDOOR DESIGN PANEL

(76) Inventor: Ida J. Chase, 6907 Valley Park Rd., Capitol Heights, MD (US) 20743

( * ) Notice: Subject to any disclaimer, the term of this patent is extended or adjusted under 35 U.S.C. 154(b) by 2 days.

(21) Appl. No.: 11/470,707

(22) Filed: Sep. 7, 2006

(51) Int. Cl.
*F21S 8/00* (2006.01)
*F21V 23/04* (2006.01)
*G09F 13/00* (2006.01)

(52) U.S. Cl. ..... 362/152; 362/276; 362/431; 40/543

(58) Field of Classification Search ..... 362/152, 362/812, 276, 253, 431; 40/542, 575, 577, 40/578, 605, 543
See application file for complete search history.

(56) References Cited

U.S. PATENT DOCUMENTS 2,585,461 A * 2/1952 Hirsch ..... 423/622
2,594,903 A * 4/1952 Freedman et al. ..... 40/615
2,629,956 A * 2/1953 Switzer ..... 428/29
2,731,745 A * 1/1956 O'Neill ..... 40/463
2,736,113 A * 2/1956 Morrison ..... 40/505
3,318,031 A * 5/1967 Whaley et al. ..... 40/592
3,475,845 A * 11/1969 Estva, Jr. ..... 40/430
3,591,942 A * 7/1971 Van Swearingen ..... 40/615
4,209,926 A * 7/1980 Ueki et al. ..... 40/437
4,424,449 A * 1/1984 O'Brill ..... 250/461.1
5,003,716 A * 4/1991 Dyar ..... 40/503
5,149,568 A 9/1992 Beck
D343,642 S 1/1994 Ho
5,329,716 A * 7/1994 Fite ..... 40/575
5,416,674 A * 5/1995 Murai ..... 362/84
5,887,856 A 3/1999 Everly, II
5,965,242 A 10/1999 Patton et al.
6,557,282 B1 * 5/2003 Cleaver ..... 40/541
6,745,507 B2 * 6/2004 Golding ..... 40/564
2003/0132396 A1 7/2003 Wang
2004/0159800 A1 8/2004 Reilly
2005/0174776 A1 * 8/2005 Althaus ..... 362/276

* cited by examiner

*Primary Examiner*—Ismael Negron
*Assistant Examiner*—David R Crowe
(74) *Attorney, Agent, or Firm*—Crossley Patent Law; Mark A. Crossley

(57) ABSTRACT

An outdoor design panel that combines a number of plats and fluorescent pigments to create a displayed design, with an option to incorporate numerous lighting elements within the design itself. The design panel is pre-fabricated and can optionally be highlighted with a number of lighting elements incorporated into the panel. The lighting elements are powered by a battery linked to a solar cell, with a lighting sensor being utilized in between the battery and the lighting elements to control the flow of power to the lighting elements. The lighting sensor acts as a switch and will allow power to flow in between the battery and the lighting elements once the external light level falls below a certain level.

5 Claims, 3 Drawing Sheets

OUTDOOR DESIGN PANEL

BACKGROUND OF THE INVENTION

The present invention concerns that of a new and improved outdoor design panel that combines a number of plats and fluorescent pigments to create a displayed design, with an option to incorporate numerous lighting elements within the design itself.

DESCRIPTION OF THE PRIOR ART

U.S. Pat. No. 5,149,568, issued to Beck, discloses a glow-in-the-dark artwork that includes a luminescent layer formed of a luminescent material such as a fluorescent or phosphorescent paint or coated layer.

U.S. Application No. 2003/0132396, filed by Wang, discloses a luminescent photoconductor cell integrally blended with light-emitting materials or connected with a luminescent layer composed of a number of light emitting materials.

U.S. Pat. No. 5,965,242, issued to Patton et al., discloses a medium having a phosphorescent material and a system and method for producing images on the medium using a digital printer.

U.S. Application No. 2004/0159800, filed by Reilly, discloses an illuminated article utilizing a base member having an outer surface.

U.S. Pat. No. 2,629,956, issued to Switzer, discloses a method of surface ornamentation and products therefore.

SUMMARY OF THE INVENTION

The present invention concerns that of a new and improved outdoor design panel that combines a number of plats and fluorescent pigments to create a displayed design, with an option to incorporate numerous lighting elements within the design itself. The design panel is pre-fabricated and can optionally be highlighted with a number of lighting elements incorporated into the panel. The lighting elements are powered by a battery linked to a solar cell, with a lighting sensor being utilized in between the battery and the lighting elements to control the flow of power to the lighting elements. The lighting sensor acts as a switch and will allow power to flow in between the battery and the lighting elements once the external light level falls below a certain level.

There has thus been outlined, rather broadly, the more important features of an outdoor design panel that the detailed description thereof that follows may be better understood and in order that the present contribution to the art may be better appreciated. There are, of course, additional features of the outdoor design panel that will be described hereinafter and which will form the subject matter of the claims appended hereto.

In this respect, before explaining at least one embodiment of the outdoor design panel in detail, it is to be understood that the outdoor design panel is not limited in its application to the details of construction and to the arrangements of the components set forth in the following description or illustrated in the drawings. The outdoor design panel is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present outdoor design panel. It is important, therefore, that the claims be regarded as including such equivalent constructions insofar as they do not depart from the spirit and scope of the present invention.

It is therefore an object of the present invention to provide an outdoor design panel which has all of the advantages of the prior art and none of the disadvantages.

It is another object of the present invention to provide an outdoor design panel which may be easily and efficiently manufactured and marketed.

It is another object of the present invention to provide an outdoor design panel which is of durable and reliable construction.

It is yet another object of the present invention to provide an outdoor design panel which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
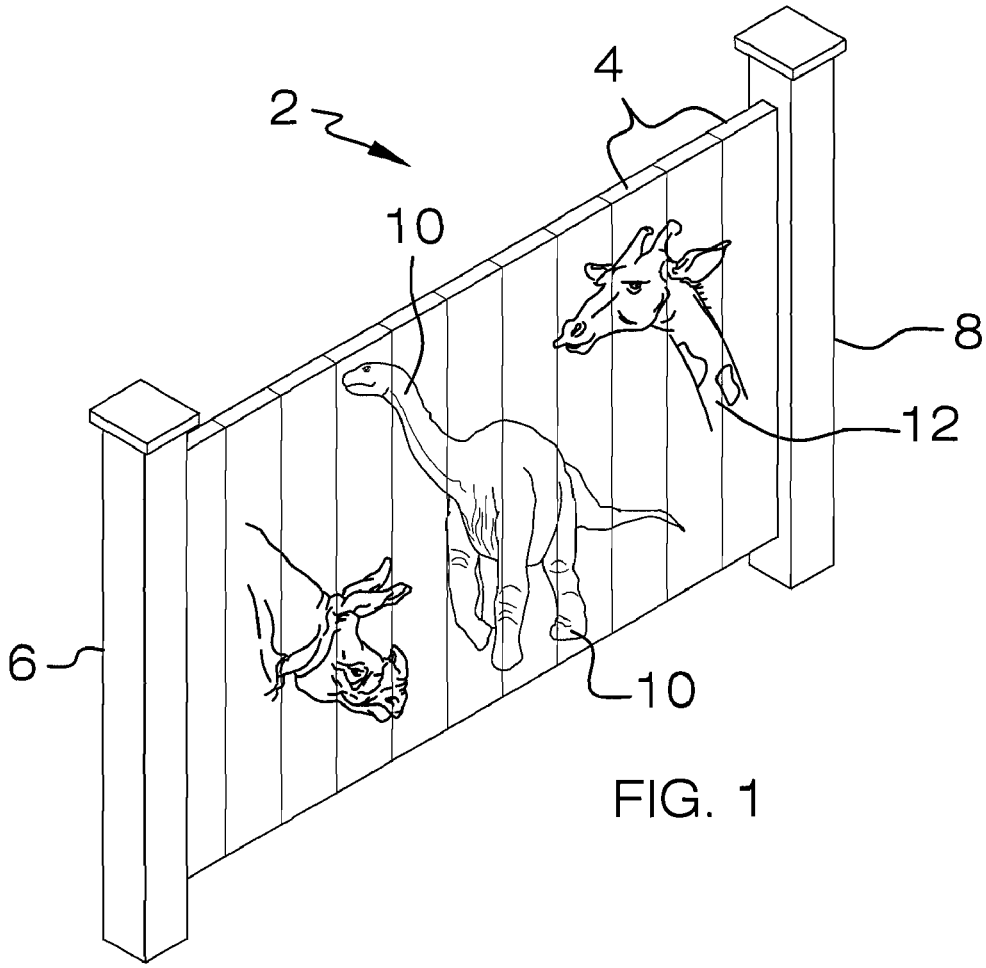
FIG. 1 shows a perspective representational view of an outdoor design panel.
Figure 2:
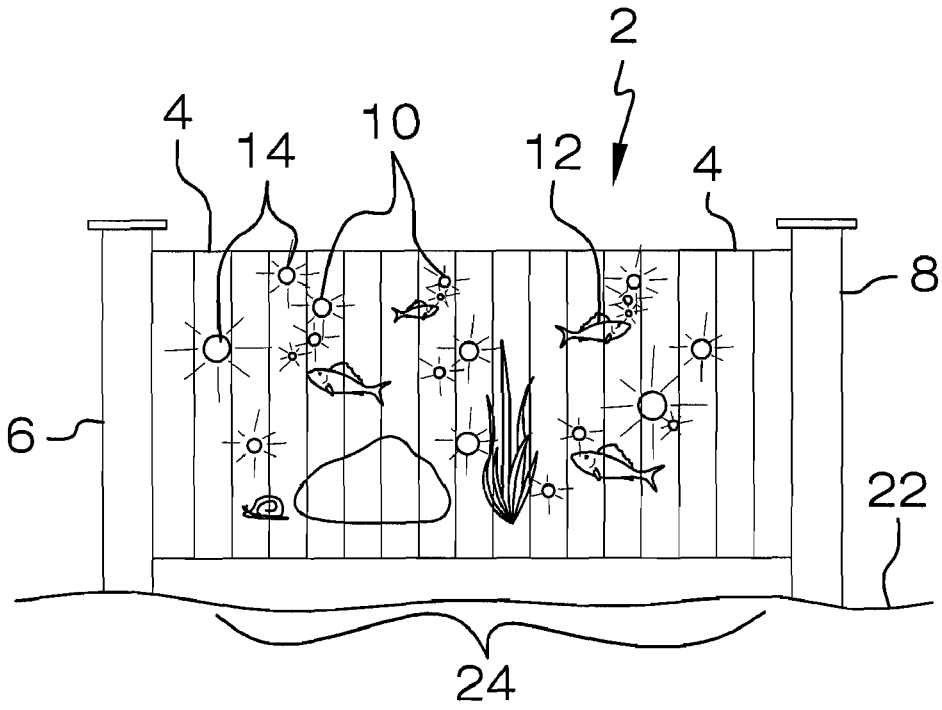
FIG. 2 shows a front representational view of an outdoor design panel.
Figure 3:
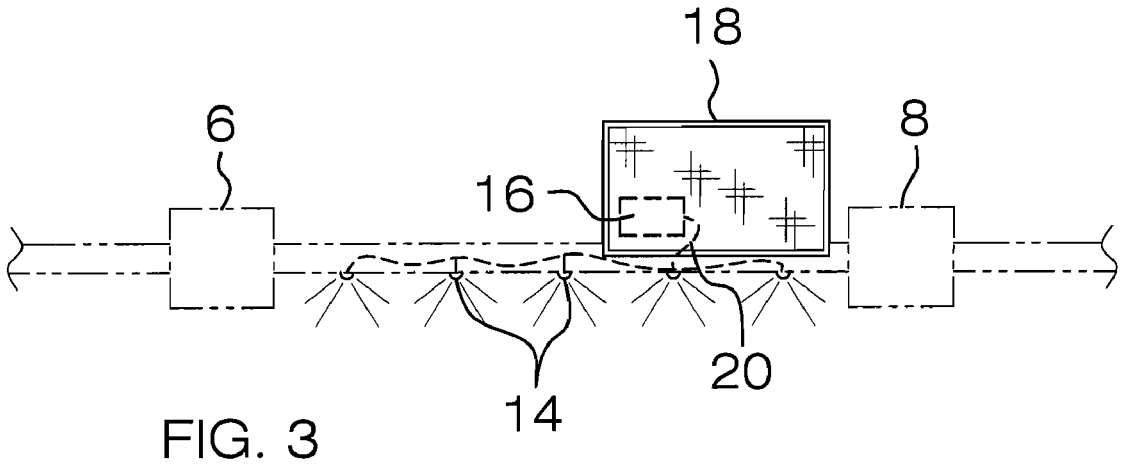
FIG. 3 shows a top representational view of an outdoor design panel, highlighting the battery, the solar cell, and the switch.
Figure 4:
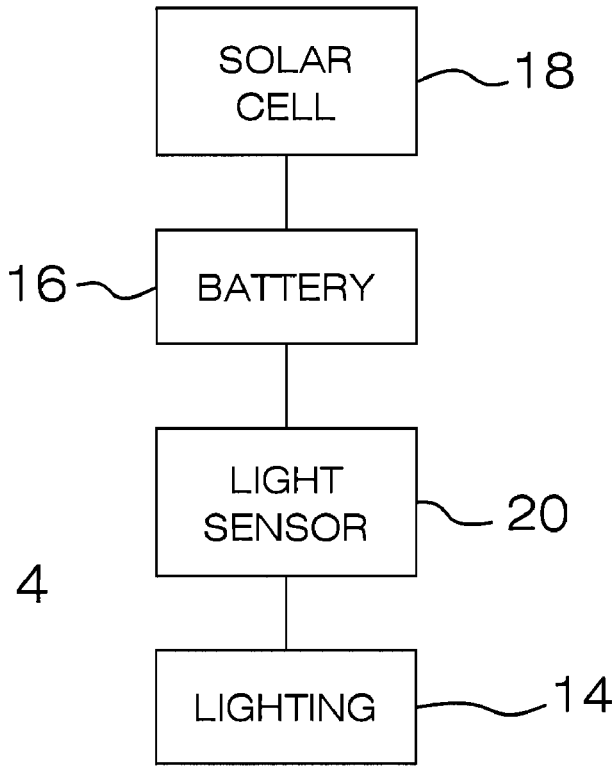
FIG. 4 shows a diagram highlighting the interconnectivity between the various elements of the outdoor design panel.
Figure 5:
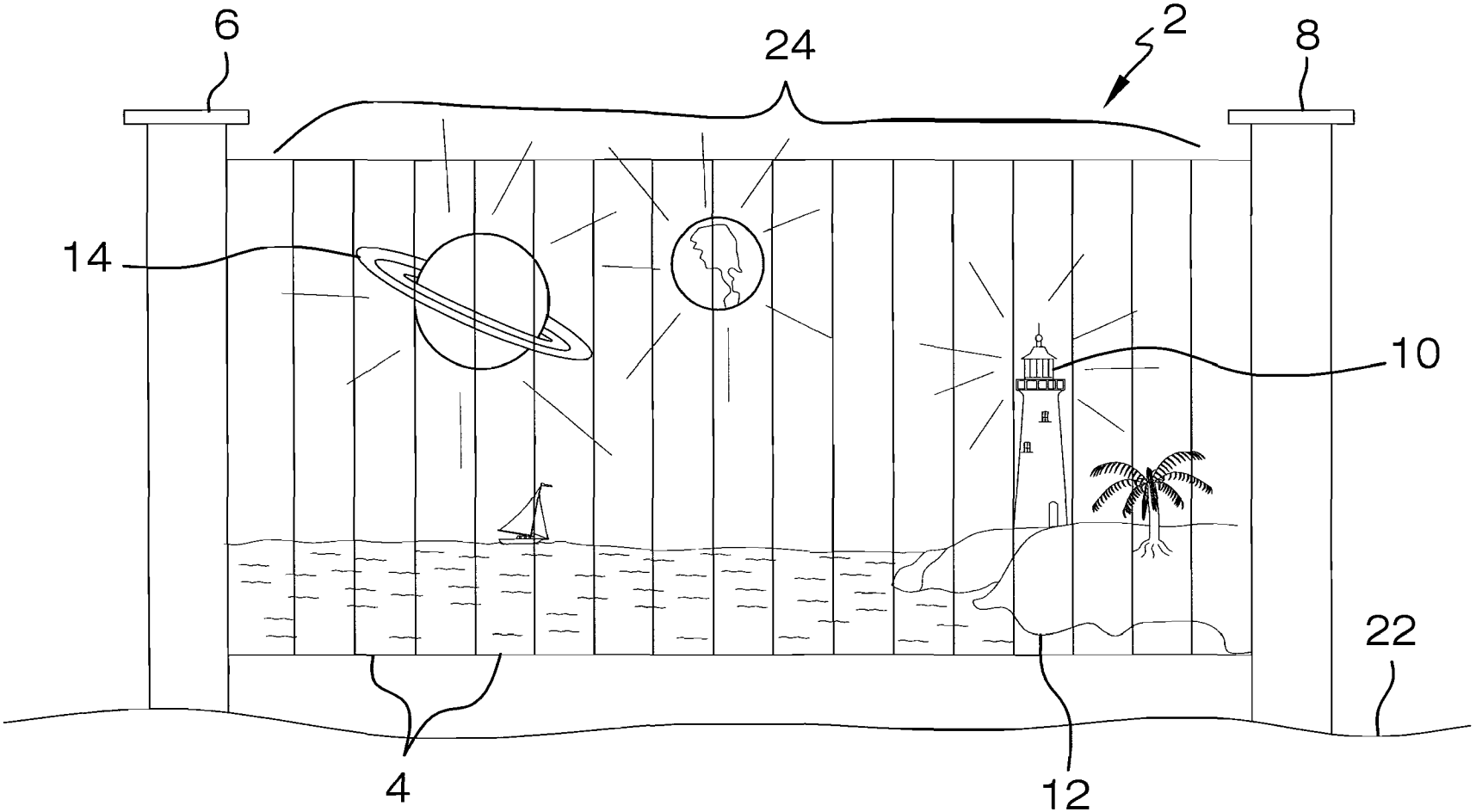
FIG. 5 shows a front representational view of an outdoor design panel with incorporated lighting elements.

With reference now to the drawings, and in particular to FIGS. 1 through 5 thereof, a new outdoor design panel embodying the principles and concepts of the present invention and generally designated by the reference numeral 2 will be described.

As best illustrated in FIGS. 1 through 5, the outdoor design panel 2 comprises a plurality of slats 4, with each slat 4 having two ends comprising a top end and a bottom end. Each slat 4 further includes various markings 10 on it. When these markings 10 are combined by putting the slats 4 into the proper order, the markings 10, in effects, cause a design 24 to be created.

The plurality of slats 4, when put together, are mounted on two support posts 6 and 8, with these support posts 6 and 8 being driven into a ground surface 22. The ground surface 22 is preferably an outdoor ground surface.

The markings 10 are preferably fabricated from at least one fluorescent pigment 12, with the pigment 12 designed to glow when black light (ultraviolet light) is turned on near the markings 10. The pigments 12 utilized with the markings 10 can come in one or more colors.

To further enhance the panel 2, a plurality of lighting elements 14 can be incorporated into the various slats 4. These lighting elements can either be regular light or ultraviolet light, which will help to bring out the fluorescent capabilities of the fluorescent pigment 12.

The lighting elements are preferably powered by a rechargeable battery 16 which is attached to a photovoltaic cell 18. The cell 18 receives sunlight and converts it into power, which is then stored in the battery 16. In between the battery 16 and the various lighting elements 14, however, is located a light sensor 20. The sensor 20 acts as an automatic switch and only allows power to travel from the battery 16 to the lighting elements 14 when the light outside falls below a certain threshold. Once this occurs, the sensor 20 will enter into a closed position, thereby allowing power to flow from the battery 16 to the various lighting elements 14. Until this occurs, the sensor 20 will be in an open position, preventing power from flowing from the battery 16 to the various lighting elements 14. The sensor 20 can be adjusted by an individual to alter the actual light level at which the sensor 20 will switch to the "on" position and thereby allow the lighting elements 14 to turn on.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. An outdoor design panel comprising:

a plurality of fixed nonmovable slats, each slat having two ends comprising a top end and a bottom end;

a plurality of markings placed on the slats of the plurality of slats;

means for vertically mounting the plurality of slats comprising:

a ground surface; and a pair of support posts comprising a first support post and a second support post, wherein each of the support posts is driven into the ground surface;

wherein the slats of the plurality of slats are directly attached to one another along the lengths thereof into a panel; and further wherein the panel is attached to the support posts;

wherein the panel further comprises a design, the design being created from the markings when the slats are attached to one another; and wherein the markings are fabricated from at least one black-light activated fluorescent pigment wherein the panel further comprises a plurality of ultraviolet light elements, the light elements being incorporated into the slats of the plurality of slats, and power means for providing power to the plurality of light elements.

2. The outdoor design panel according to claim 1 wherein the power means for providing power to the plurality of light elements further comprises:

(a) a battery, (b) a solar cell attached to the battery, and (c) a switch attached to the battery, the switch also being attached to the plurality of light elements.

3. The outdoor design panel according to claim 2 wherein the battery is rechargeable.

4. The outdoor design panel according to claim 3 wherein the switch attached to the battery further comprises a light sensor, wherein the light sensor detects the amount of external light, wherein the light sensor has two positions comprising an "on" position and an "off" position, wherein the light sensor will switch from the "off" position to the "on" position once the level of external light falls below a certain level, wherein the light sensor acts as a closed circuit when the light sensor is in the "on" position, and further wherein the light sensor acts as an open circuit when the light sensor is in the "off" position.

5. The outdoor design panel according to claim 4 wherein the light sensor is adjustable.

* * * * *